US005951070A

United States Patent [19]

Spurr

[11] Patent Number: 5,951,070

[45] Date of Patent: Sep. 14, 1999

[54] VEHICLE DOOR LOCK ACTUATOR

[75] Inventor: Nigel Spurr, Birmingham, United Kingdom

[73] Assignee: Meritor Light Vehicle Systems (UK) Ltd., Birmingham, United Kingdom

[21] Appl. No.: 09/051,947

[22] PCT Filed: Sep. 18, 1996

[86] PCT No.: PCT/GB96/02291

§ 371 Date: Jun. 26, 1998

§ 102(e) Date: Jun. 26, 1998

[87] PCT Pub. No.: WO97/15741

PCT Pub. Date: May 1, 1997

[30] Foreign Application Priority Data

Oct. 24, 1995 [GB] United Kingdom ..... 9521790

[51] Int. Cl.[6] ..... E05C 3/06

[52] U.S. Cl. ..... 292/201; 292/216; 292/DIG. 23

[58] Field of Search ..... 70/262, 263, 264, 70/279.1, 280; 292/201

[56] References Cited

U.S. PATENT DOCUMENTS

| | | | |
|---|---|---|---|
| 4,135,377 | 1/1979 | Kleefeldt et al. . | |
| 4,518,181 | 5/1985 | Yamada | 292/201 |
| 5,386,713 | 2/1995 | Wilson | 292/144 |
| 5,409,277 | 4/1995 | Rogers, Jr. et al. | 292/201 |
| 5,464,260 | 11/1995 | Bartel et al. | 292/201 |
| 5,538,298 | 7/1996 | Ikeda | 292/201 |
| 5,603,537 | 2/1997 | Amano et al. | 70/265 |
| 5,667,263 | 9/1997 | Kleefeldt et al. | 292/201 |
| 5,855,130 | 1/1999 | Rorabacher et al. | 70/279.1 |

FOREIGN PATENT DOCUMENTS

| | | | |
|---|---|---|---|
| 33 19 354 | 12/1983 | Germany . | |
| 3924210 | 3/1990 | Germany | 70/264 |
| 2 217 380 | 10/1989 | United Kingdom . | |
| 2262769 | 6/1993 | United Kingdom | 70/262 |

*Primary Examiner*—Darnell M. Boucher
*Assistant Examiner*—Teri Pham
*Attorney, Agent, or Firm*—Marshall & Melhorn

[57] ABSTRACT

Actuator for vehicle door locks provides powered shifting of a mechanism component while permitting manual operation thereof. A motor powers a driver annulus having internal teeth and notches in respective axial zones with each tooth being diametrically opposite a notch. A spring-loaded index across the annulus interior has a tail co-acting with the notches and a head co-acting with the teeth and is guided by fixed structure that it can only move angularly to displace the component to which it is linked, by indexing past a tooth when its tail is in a notch. Powered movement of the annulus causes the teeth to selectively shift the index, but manual displacement of the component causes the index to spring past the relevant tooth.

10 Claims, 2 Drawing Sheets

VEHICLE DOOR LOCK ACTUATOR

BACKGROUND OF THE INVENTION

1. Field of the Invention

This invention relates to locking systems for vehicle doors and other closures of the kind in which individual locks are interconnected through a central control unit for electrical or other powered actuation whereby locking or unlocking off some or all doors or other closures can be effected from a single control station actuated from within or outside the vehicle, herein referred to as "Central Locking Systems". The locking mechanism and associated power actuator will provide for manual operation whereby the respective door can be locked and unlocked using a conventional interior sill button or other manually operated input element, and, maybe, by manual operation of a cylinder or other key controlled exterior lock.

2. Summary of Related Art

DE-A3319354 describes a locking system power actuator with facility for manual operation in which a powered driver has connection with an output element by way of an index resiliently urged into coacting engagement with an indexing formation of the driver so that the output element is positively indexed relative to the driver to one or other of its locked and unlocked positions on manual operation, and powered displacement of the driver carries the output element between said positions.

OBJECT OF THE INVENTION

The object of the invention is to provide a power actuator which is simple and economical to produce and install, is durable and reliable in service, compact and with few moving parts, which is quiet and efficient in use, and which contributes to efficient and effective manual operation as well as powered operation.

SUMMARY OF THE INVENTION

According to the invention there is provided a power actuator for shifting vehicle door lock or other closure mechanism selectively between a locked or other first condition and an unlocked or other second condition by powered operation while permitting manual operation also for effecting said shifting, said actuator being distinguished by the characterising part of appended claim 1.

Conveniently the driver is annular so that said first and second abutment portions are constituted by generally diametrally opposing interior wall portions of the annulus, the index being received within the annulus and the powered movement of the latter being rotational, i.e. said first path of movement is circular about the axis of the annulus.

Said annulus is conveniently powered by an electric motor having a worm pinion engaging an externally toothed periphery of said annulus. Preferably the helix angle of the worm pinion is selected to permit driven rotation thereof by rotational force above a selected value applied to the annulus to enable manual release of the mechanism in the event of a failure of power operation while the index is in positive engagement between the annulus and output element.

The output element may be a lever one arm of which is directly or indirectly coupled to the index for movement therewith and said lever may be fulcrumed co-axially with the annulus or upon an axis spaced from the axis of the annulus and within or outside the envelope of revolution thereof, whereby since second path of movement is angular.

The annular form of driver will preferably be provided with a series of equi-angularly spaced teeth and notches right around its interior periphery, the teeth being in one axial zone of said periphery and the notches, each being diametrically opposite a respective tooth, being in another axial zone thereof, the head and tail of the index being in stepped relationship in the diametrical plane for alignment with the respective axial zones.

The mounting will preferably include slots or other guide formations with which control portions of the index engage to define the displacement of the latter during operation relative to the driver.

An example of the invention is now more particularly described with reference to the accompanying drawings wherein:

DETAILED DESCRIPTION OF THE PREFERRED EMBODIMENT

Figure 1:
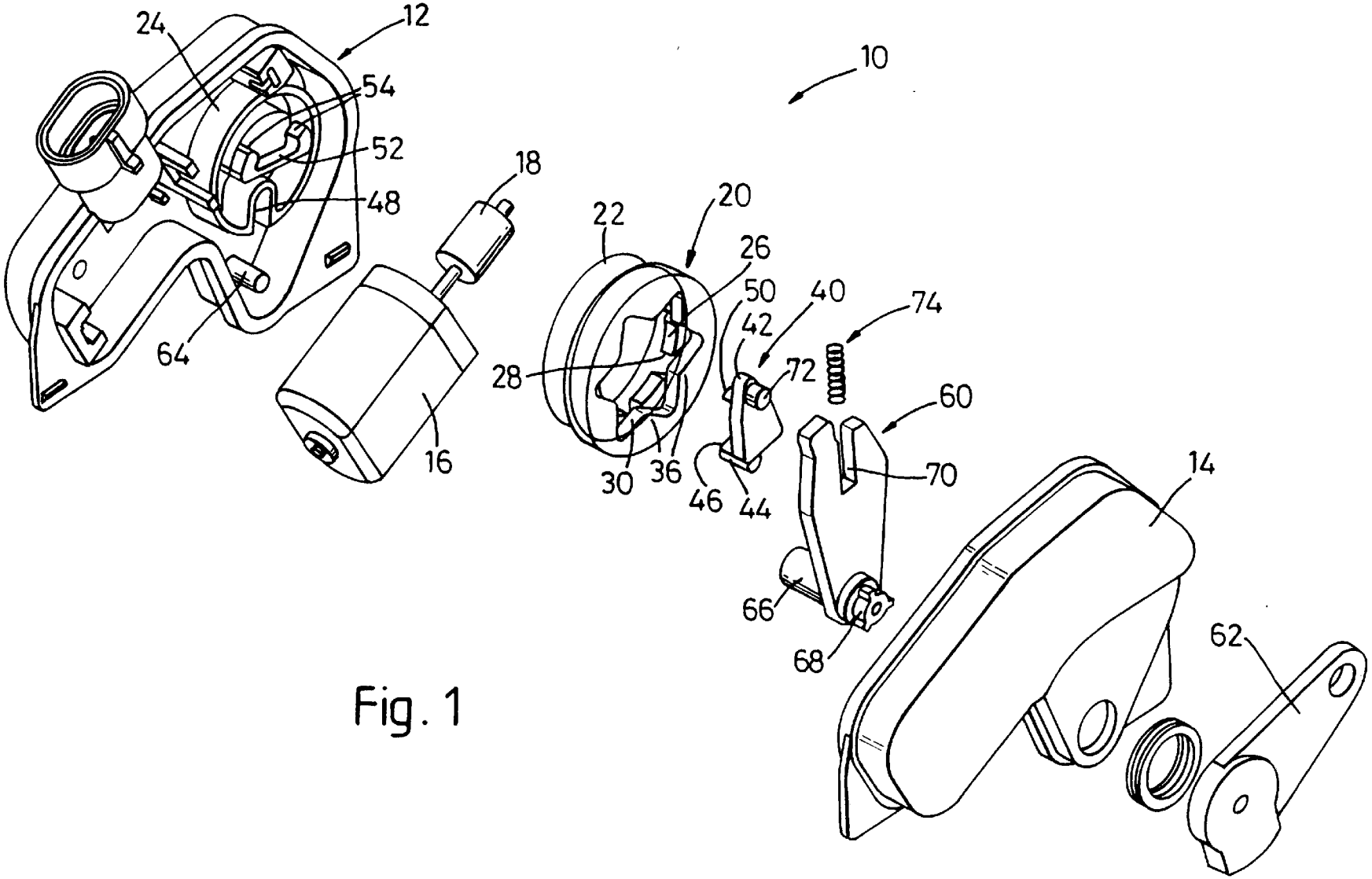
FIG. 1 is an exploded perspective view of a vehicle lock actuator.
Figure 2:
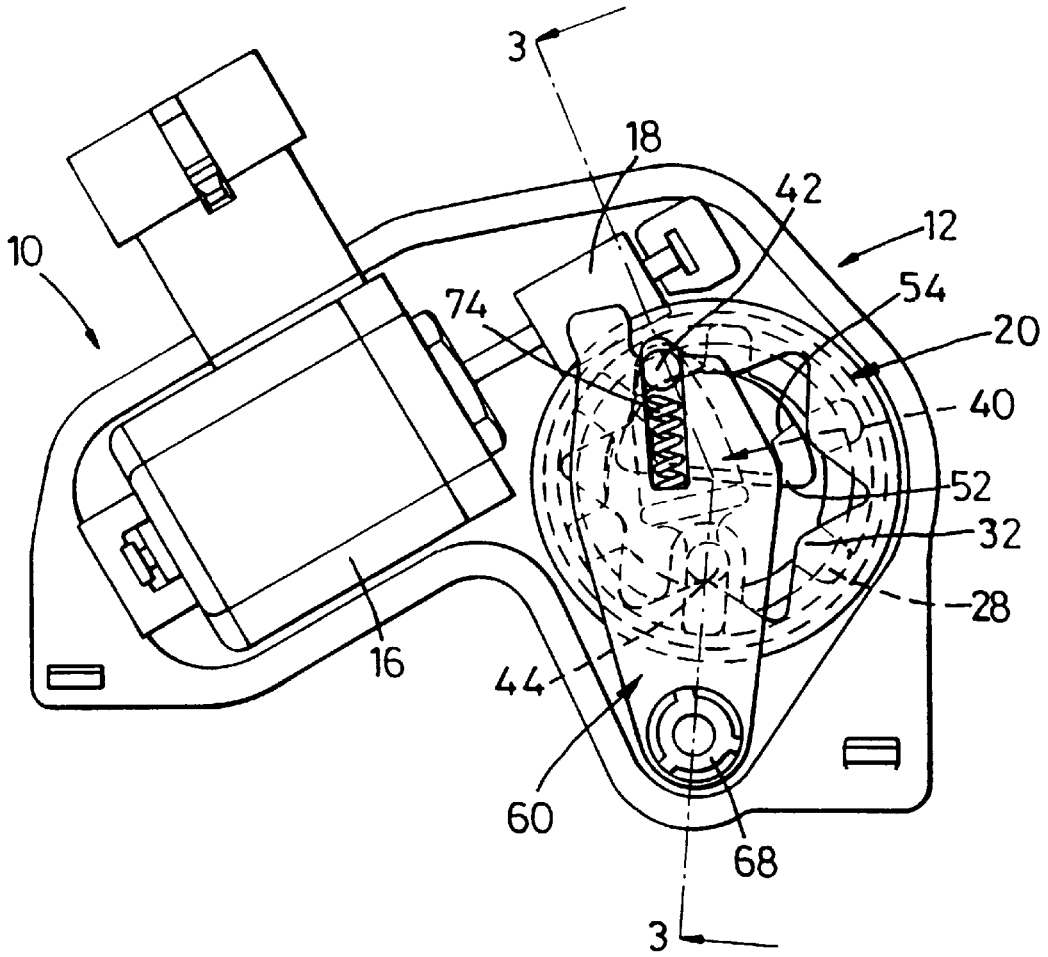
FIG. 2 is an enlarged front elevation thereof in assembled condition but with a housing cover and other parts removed.
Figure 3:
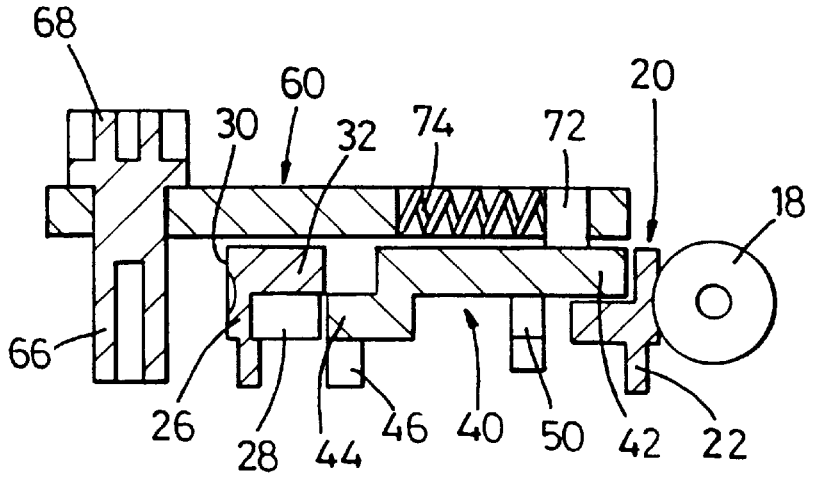
FIG. 3 is a diagrammatic section on line 3—3 of FIG. 2 but not including the housing.

A power actuator 10 includes a housing base 12 which serves as a fixed mounting for other components and is provided with a mating cover 14. The housing contains an electric drive motor 16 having a worm pinion 18 on its output shaft.

Pinion 18 meshes with the externally toothed periphery of a driver in the form of an annulus 20, the axially rearmost part of which, as viewed in FIG. 1, is a collar 22 with a continuous cylindrical interior wall surface journalled for rotation on a sleeve formation 24 of base 12.

The remaining axial extent of annulus 20 forwardly of collar 22 is divided into two axial zones, a first axially median zone 26 adjoining collar 22 being provided with equi-angular spaced radially extending notches 28, (in this example six in number). The second and axially outer zone 30 adjoining zone 26 is formed to provide a series of equi-angularly spaced radially inwardly projecting teeth 32 equal in number to notches 28, i.e. six in this example, the tip of each tooth being angularly coincident with a respective notch 28 so that there is a said notch diametrally opposite each said tooth, but axially offset therefrom.

Teeth 32 have flat side faces with an included angle, in this example, of about 130° and the gaps or valleys between each pair of adjacent teeth 32 therefore has an included angle of about 75° giving slopes providing a camming action referred to hereafter.

Located within annulus 20 is an index 40 guided for restricted floating movement relative to the annulus as further described below. Index 40 is a generally elongate formation having a head 42 at one end and a tail 44 at the other end, the overall length being greater than the internal diameter of annulus 20 clear of teeth 32 and the lands between notches 23 by approximately the depth of said notch (which is substantially equivalent to the depth of the valleys or gaps between teeth 32).

Head 42 is profiled and axially disposed to coact with the side faces of teeth 32 and engage in the gaps therebetween and tail 44 is axially offset inwardly as viewed in FIG. 1 to clear teeth 32 and is profiled to enter notches 28.

Tail 44 includes a rearward extension projecting into collar 22 and constituting a control peg 46 engaging a radially extending control slot 48 of base 12, defined by a radially inwardly extending pocket of sleeve formation 24.

The index also includes a stop 50 projecting rearwardly like peg 46 but remote therefrom near head 42. Stop 50 co-acts with a limit formation 52 of base 12 within the upper half sleeve formation 24 as viewed in FIG. 1.

Limit formation 52 has a pair of spaced buffers 54 which limit sideways swinging of head 42.

Index 40 can thus pivot about the axis of control peg 46 angularly across the centre of annulus 20 to an extent limited by contact of stop 50 with the limit formations 52 and can also be displaced longitudinally or near longitudinally by radial movement of control peg 46 along slot 48.

An output element in the form of a two part bell crank lever 60, 62 is fulcrumed on a stub shaft 64 of base 12, a journal portion 66 of first arm 60 of said lever including a splined projection 68 which extends through cover 14 on assembly and mounts a second arm 62 of the lever externally of the housing.

First arm 60 extends generally upwardly as seen in FIG. 1 to lie across the outer end of annulus 20 overlying index 40. A longitudinal slot 70 in the distal end of arm 60 engages an outwardly projecting crank pin 72 at the head end of index 40. A compression spring 74 locates in slot 70 and bears on the radially inner side of pin 72, so resiliently urging index 40 upwards as seen in FIG. 1, i.e. urging head 42 into engagement with an abutment portion of annulus 20 constituted by the immediately adjacent peripheral wall with a respective tooth or teeth 32.

In use arm 62 of lever 60 will be linked to associated locking mechanism of the vehicle door or other closure. Said mechanism will also include provision for its manual operation, e.g. by an interior sill button of the door, in known manner for locking and unlocking, said operation causing angular displacement of lever 60 between first and second, i.e. locked and unlocked, positions, arm 60 being displaced to one side of the other of the axis of annulus 20 by said operation.

In the course of such manual displacement head 42 of index 40 which is being urged upwards by spring 74 will ride or cam across the co-acting tooth 32 of annulus 20 from the valley or gap at one side thereof to the equivalent valley or gap at the other side, the force of spring 74 serving to positively index lever 60 to the locked or unlocked position, helping it on its way by said camming action as soon as the head has passed the mid-position crossing the radially inwardly projecting tip of the relevant tooth. During said movement the notch 28 which is diametrally opposite said tooth allows tail 44 of index 40 to move radially outwardly guided by control slot 48 and the index will also be swung angularly about its control peg 46 between the limits determined by buffers 54. This manual operation can take place in either direction. The indexing effect gives a positive feel to the manual operation without involving excess loading or strain, and ensures that the mechanism is fully shifted into and retained at the selected locked or unlocked condition until a further operation takes place.

If powered operation of the locking mechanism is to take place motor 16 will be energised for drive in whichever direction is appropriate for the relevant change of condition, the system including switches in known manner to detect and set the required sequence, so rotating annulus 20 in the direction required for movement of lever 60 from whichever position it is at to the other position. Rotation of annulus 20 carries the lowermost part of its peripheral wall as viewed in FIG. 1, which constitutes an opposing or second abutment relative to the upper or first abutment mentioned above, past the tail 44 of index 40 so that a land between notches 28 is aligned therewith and blocks downward displacement of the index. This prevents head 42 from being cammed downwardly by co-action with teeth 32, it must remain in engagement with the relevant inter-tooth valley or gap so that it is carried angularly with annulus 20 and positively drives arm 60 and hence the locking mechanism from one position to the other.

Once the mechanism has been power actuated to the selected condition, movement being limited by the relevant buffer 54, drive ceases and the index will again be positioned with tail 44 aligned with a notch 28 permitting manual operation in the reverse direction if required, or a further power operation in the better direction.

The abutment faces of buffers 54 which are engaged by stop 50 are angled so that they tend to cam index 40 towards the first abutment constituted by the relevant tooth valley while power driving force is applied thereto, so ensuring that index 40 does not jump or start to jump the next tooth 32 even though its tail is again aligned with one of the notches 28.

It will be noted that no movement of annulus and its geared drive connection to motor 16 takes place during manual operation, there is no back driving of a gear train or the like so avoiding noise and strain on the mechanism when manual operation takes place. Nor is there any need for a centrifugal, magnetic or other clutch in the drive train or related to motor with its problems of wear and unreliability, as is required in many conventional power actuators. Moreover, resiliently loaded indexing is provided without the need for extra components such as spring loaded toggle mechanisms or overcentre devices for this purposes as is required in some known actuator mechanisms.

Conversely, under power operation, there is no involvement of the resiliently loaded indexing function, i.e. the power drive does not have to overcome indexing loading as with many known actuators so requiring substantially less driving force and again reducing noise, wear and tear, and loading on components. Furthermore, conventional indexing pre-loads the mechanism so that excessive power is required to start motion from rest and counter the contrary indexing force during the first half of travel which is trying to return the mechanism to its starting point. However, once the mid-point has been passed the indexing force supplements the power input so that the final part of the travel, which has already built up speed in overcoming static inertia of the components, is accelerated rapidly with maximum force just when it has to come to a stop giving very noisy operation and substantial risk of damage or failure to components.

To guard against the possibility of the mechanism being jammed if power actuation should fail in a situation where index 40 was not free to ride past a tooth 32, worm pinion 18 is preferably formed with a helix angle which will allow back drive if lever 60 has manual driving force applied to it above a predetermined level, but the mechanism can be manually reset to one or other conditions by applying somewhat more force than normal, and can then be further operated manually or by power as referred to above.

It will be appreciated that the output element can take various forms such as a link guided for rectilinear movement or various types of lever, or lever and linkage combinations. For some applications a simple lever pivoted co-axially with the annulus can be used, i.e. generally overlying the index longitudinally.

The annular form of driver described is preferred because this provides an unlimited sequence of operations of either type in either direction and/or mixture thereof, for example a powered operation in one direction followed by a manual operation in the opposite direction and then a repeat of that sequence any number of times will rotate annulus 20 so that teeth 32 pass index 40 in succession. Such mixed operations are not always possible with the case with known power actuators, some of which require an "idle" power or manual operation to reset the mechanism if certain logic is not followed, e.g. if the power unlocking is not followed by a power locking and this can be frustrating to the user. In comparison a locking system incorporating the invention will be substantially foolproof and user friendly.

It is to be understood that the invention contemplates other forms of driver and/or index than those described above although the latter are seen as desirable for giving all the stated advantages. Thus, the driver could take the form of a slider guided for rectilinear movement in a first path and driven by a push-pull or plunger type motor such as a pneumatic or hydraulic ram, the index acting between opposing abutments provided with at least one tooth and at least one opposing notch. Said index would be connected to a suitable output element such as a slider or lever arm, the index being controlled by formations of a fixed mounting and having resilient loading engaging it with one or other side of the tooth and prevented from disengagement under the principles described above during power actuation but permitting indexing from side to side of the tooth under movement of the output element by co-acting with said notch during manual operation. Drivers having arcuate abutment formations with one or more teeth and/or notches are also contemplated.

I claim:

1. A power actuator (10) for shifting vehicle door lock or other closure mechanism selectively between a locked or other first condition and an unlocked or other second condition by powered operation while permitting manual operation also for effecting said shifting, said actuator comprising:

(a) an operatively fixed mounting (12);

(b) a driver (20) guided on said mounting for powered movement in a first path;

(c) an output element (60) for attachment to said closure mechanism in use and guided for movement in a second path between first and second positions, said manual operation causing said movement; and (d) an index (40) in coacting relationship with the driver and the output element to transmit powered movement of the driver to the output element to move the latter between said positions, the driver having abutment portions which comprise at least one indexing formation (32), the index being resiliently urged longitudinally towards said formation, and the index having a head end (42) shaped to engage on one or other side of said formation to effect indexing of the output element positively to one or other position as manual operation displaces the output element and index relative to the driver:

characterized in that said abutment portions are spaced across the first path in opposing relationship, one said abutment having said at least one indexing formation in the form of a tooth projecting towards the second abutment, and the second abutment having at least one notch (28) opposite said tooth; the index being located lengthwise between the abutment portions with motion transmitting connection to the output element allowing limited freedom of lateral movement of the index relative thereto, a tail end (44) of the index entering said one notch during a median part of said indexing to permit longitudinal displacement of the index allowing it to pass said tooth, said engagement of the head on a side of said tooth transmitting the powered movement of the driver to the output element positively through the index while moving the tail end laterally out of alignment with the or any said notch so that the second abutment prevents longitudinal displacement of the index which would free the head end from said tooth.

2. An actuator as claimed in claim 1, wherein the driver is an annulus, said first and second abutment portions being constituted by generally diametrally opposing interior wall portions of the annulus, the index being received within the annuls and the powered movement of the latter being rotational so that said first path of movement is circular about the axis of the annulus.

3. An actuator as claimed in claim 2, wherein said annulus is powered. by an electric motor having a worm pinion engaging an externally toothed periphery of said annulus.

4. An actuator as claimed in claim 3, wherein a helix angle of the worm pinion is selected to permit driven rotation thereof by rotational force above a selected value applied to the annulus to enable manual release of the mechanism in the event of a failure of power operation while the index is in positive engagement between the annulus and output element.

5. An actuator as claimed in claim 2, wherein the output element is a lever one arm of which is directly or indirectly coupled to the index for movement therewith.

6. An actuator as claimed in claim 5, wherein said lever is fulcrummed co-axially with the annulus.

7. An actuator as claimed in claim 5, wherein said lever is fulcrummed upon an axis spaced from the axis of the annulus.

8. An actuator as claimed in claim 7, wherein said axis of the lever is outside the envelope of revolution of the annulus.

9. An actuator as claimed in claim 2, wherein the annulus is provided with a series of equi-angularly spaced teeth and notches right around its interior periphery, the teeth being in one axial zone of said periphery and the notches, each being diametrically opposite a respective tooth, being in another axial zone thereof, the head and tail of the index being in stepped relationship in the diametrical plane for alignment with the respective axial zones.

10. An actuator as claimed in claim 1, wherein the mounting includes slots or other guide formations with which control portions of the index engage to define the displacement of the latter relative to the drive during operation.

* * * * *